United States Patent [19]

Hung

[11] Patent Number: 4,486,144

[45] Date of Patent: Dec. 4, 1984

[54] ROTATING WIND-GUIDING SHELL FOR THE FAN

[76] Inventor: Fa C. Hung, No. 137, Nan-Hua Village, Chi-An Heiang, Hua-Lien Hsien, Taiwan, 953

[21] Appl. No.: 370,164

[22] Filed: Apr. 20, 1982

[51] Int. Cl.[3] ..... F04D 29/70; F01D 25/24

[52] U.S. Cl. ..... 415/121 G; 415/125; 416/247 R; 416/100; 98/40 V; 98/40 VM

[58] Field of Search ..... 415/121 G, 125, 150, 415/62, 146, 209; 98/40 V, 40 VM, 40 R; 416/247 R, 100

[56] References Cited

U.S. PATENT DOCUMENTS 2,936,109 5/1960 Copeland ..... 98/40 V X
3,072,321 1/1963 King, Jr. ..... 416/100 X
3,481,534 12/1969 Price ..... 98/40 V X
4,350,472 9/1982 Morimoto ..... 415/121 G X

*Primary Examiner*—Philip R. Coe
*Assistant Examiner*—Frankie L. Stinson
*Attorney, Agent, or Firm*—Holman & Stern

[57] ABSTRACT

A rotating wind-guiding shell for an electrical fan effectively changes the direction and magnitude of the blowing wind from the fan. The pressure and the direction of the wind from the fan can be varied instantaneously and the effective wind field can also be enlarged. At any place within the effective wind field, one can produce a variation of the pressure and the direction of the wind from the fan while it is continuously operating. The structure of the device is simple so that its cost is very low and it can be used as a desk-fan, floor-fan, ceiling-fan or a wall-fan by a simple adjustment at its support.

6 Claims, 9 Drawing Figures

ROTATING WIND-GUIDING SHELL FOR THE FAN

BACKGROUND OF THE INVENTION

1. Field of the Invention

The present invention relates to a device installed on a electrical fan for changing the magnitude and direction of the wind from the fan.

2. Description of the Prior Art

The conventional electrical fan has no such a device to change its wind pressure and direction. Although recently there are some kinds of fans having a device to change the blowing wind magnitude and/or direction, their function is limited.

BRIEF SUMMARY OF THE INVENTION

The object of the present invention is to provide a fan wherein variation of the magnitude and the direction of the wind from the fan can be made instantaneously.

Another object of the present invention is to provide a fan which is continuously operable while its magnitude and direction may be varied continuously.

The further object of the present invention is to enlarge the effective wind field.

The still further object of the present invention is to provide a fan having multiple uses, such as a desk-fan, a floor-fan, a ceiling-fan, and a wall-fan.

An additional object of the present invention is to lower the cost of a fan having a wind-guiding shell.

BRIEF DESCRIPTION OF THE SEVERAL VIEWS OF THE DRAWINGS

The invention will now be described in detail with reference to the accompanying drawings wherein.

DETAILED DESCRIPTION

Figure 1:
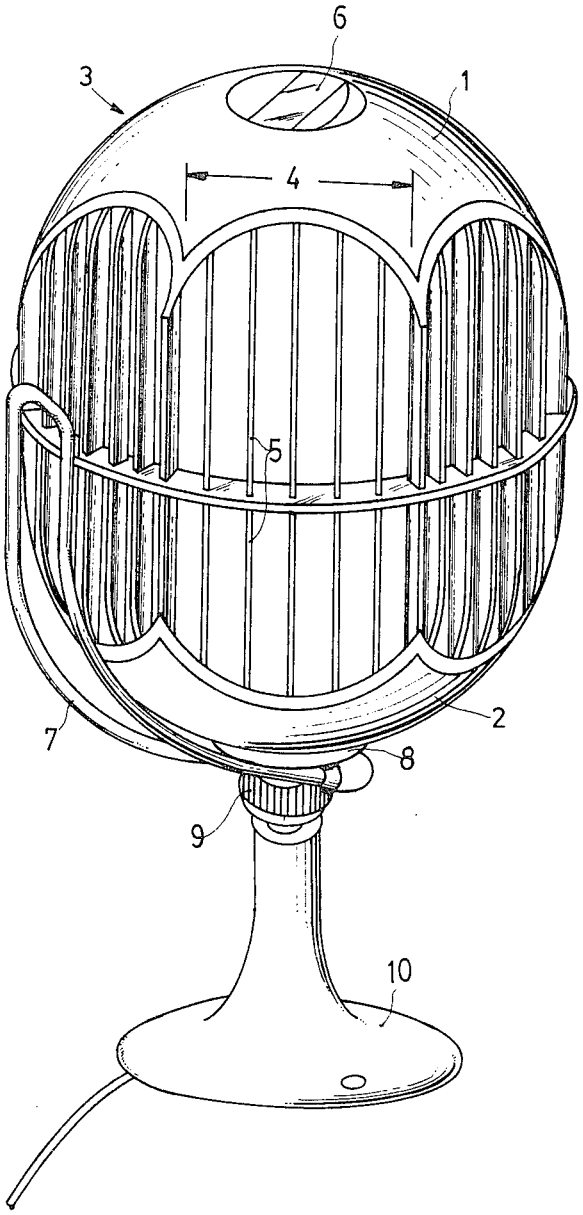
FIG. 1 is a perspective view of a preferred embodiment of the present invention.
Figure 8:
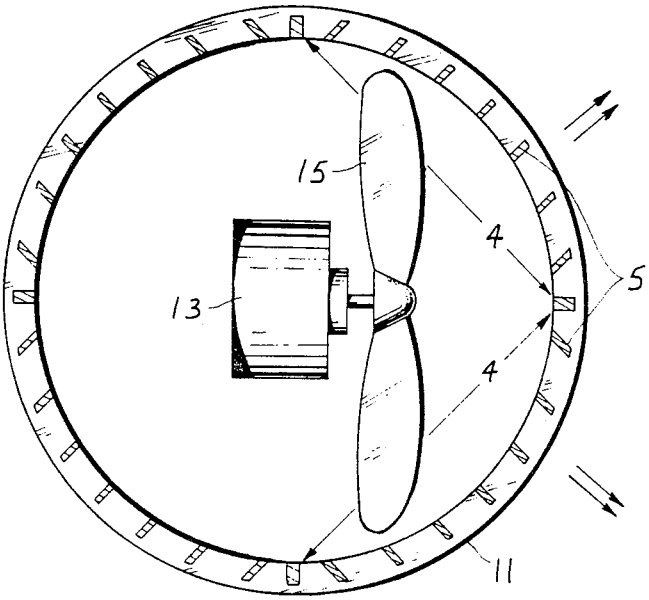

The frame of the present invention consists of two hemisphere-like shells, upper guiding-piece shell 1 and lower guiding-piece shell 2, connected together to form a sphere-like shell 3. The two hemisphere-like shells can be shaped with four, five, six, etc. faces as shown in FIG. 1. On each face there is a wind guiding vane set 4 which is composed of several parallel wind guiding vanes 5 the central vane of each set perpendicular to each own face extending substantially radially with respect to the shell 3. FIG. 1, shows the sphere-like shell 3 having six faces. FIG. 8 shows sphere-like shell 3 having four faces. Each hemisphere-like shell with its wind guiding vanes is made in on piece. Curved-adjusting frame 7 is fixed on the motor support 8. The angle changing lock nut 9 can be screwed up tightly after the stand 10 is adjusted to the desired angle (or position) along the curved-adjusting frame 7 (see FIGS. 1 and 2).

The cross sectional view of FIG. 1 shows a hook ring 11 on the upper guiding-piece shell 1 and a piece ring 12 on the lower guiding-piece shell 2. The two rings 11 and 12 are connected by deforming the outer edge portion of ring 11 over the outer edge of ring 12 to make join the upper and lower shells 1 and 2 together firmly to form the whole sphere-like shell 3.

The fan motor 13 is mounted on the shell frame 14 which is mounted on the motor support 8. The fan motor 13 drives the fan blades 15 rotatively and may be powered by home electricity in a manner well known and not shown. A synchronous-reducing-speed motor 16 is fixed on the top of the motor support 8, and the holed plate 17 has a bore hole 30 in which is fixed the shaft 18 of the synchronous-reducing-speed motor 16.

At the upper part of the upper guiding-piece shell 1 there is a ring shaped wheel 19. On the wheel 19 there is an enlarged offset portion 34 having cavity 36, in which a spring 20 and a steel ball 21 are installed with the spring 20 on top of the steel ball 21. On the plate 17 there is a set of ball detent concavities 30 arranged in a circle. The spring 20 urges the steel ball 21 into one of ball detent concavities 30 when it is exactly under the steel ball 21, whereby the sphere-like shell 3 and the synchronous-reducing-speed motor 16 are joined together and can be turned concurrently (see FIGS. 2 and 3). However, when the sphere-like shell 3 is stoped by a touch, intentionally or not, the steel ball 21 can slide out of the detent 30 and let the synchronous-reducing-speed motor 16 turn continuously so that damage to the whole frame of sphere-like shell 3 can be avoided. The sphere-like shell 3 can also be stopped by switching off the synchronous-reducing-speed motor 16. In this mode the sphere-like shell 3 can be turned by hand to a desired angle.

Figure 4A:
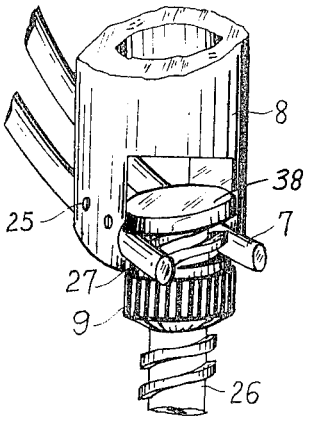
FIG. 4A is a perspective view of the middle portion of FIG. 4.
Figure 4:
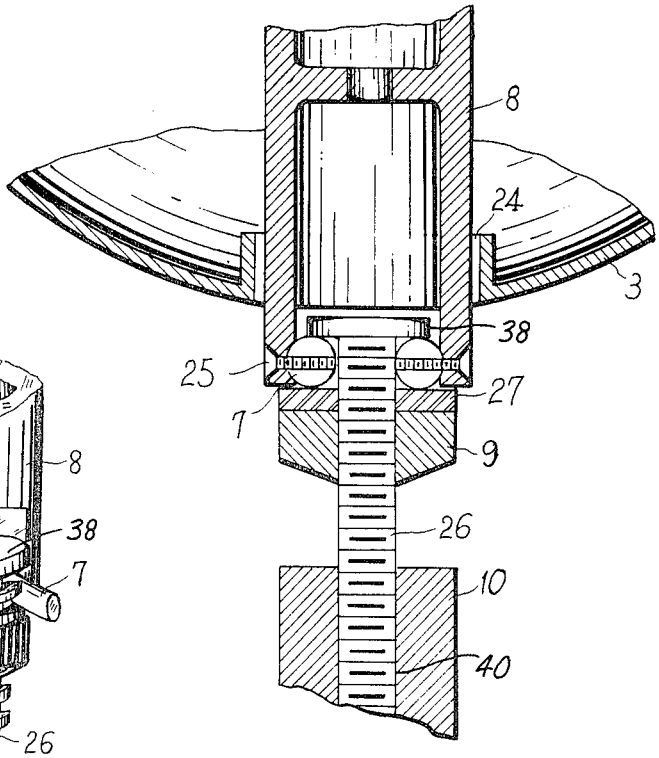
FIG. 4 is the B—B sectional view of FIG. 2.

Between the sphere-like shell 3 and the shaft 18 there is a ball bearing 22 which can make turning easier. On the screw top threaded end of the shaft 18 there is a shaft nut 23. The pressure on the plate 17 can be adjusted by turning the shaft nut 23. Between the lower end of the motor support 8 and the lower end of the lower guiding-piece shell 2 there is a pair of contacting pieces 24 to reduce the friction force between them. The curved-adjusting frame 7 is attached the lower end of motor support 8 by screws 25 (see FIGS. 2, 4 and 4A). The curved-adjusting frame 7 is pinched between the flanged upper end 38 of screw rod 26 and the angle adjusting nut 9. Between the angle adjusting nut 9 and the curved-adjusting frame 7 there is a soft washer 27 to prevent relative sliding. The screw threaded rod 26 is mounted onto the stand 10 at the lower end by being inserted into bore 40 in stud 10 and retained therein by set screw 28. A plastic end cap 29 is provided to cover each end of the curved-adjusting frame 7.

Figure 2:
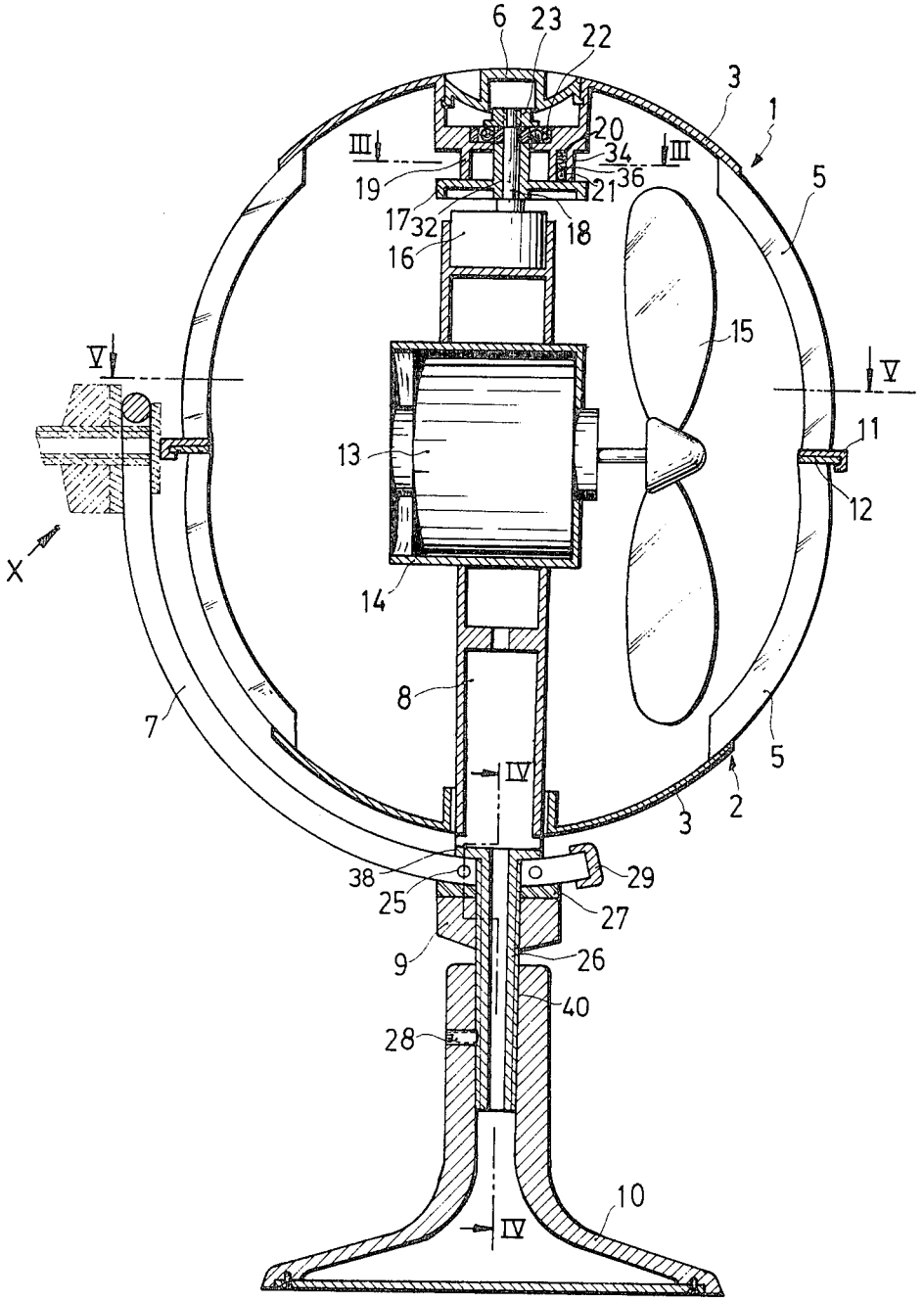
FIG. 2 is a vertical cross sectional view of the fan of FIG. 1.
Figure 3:
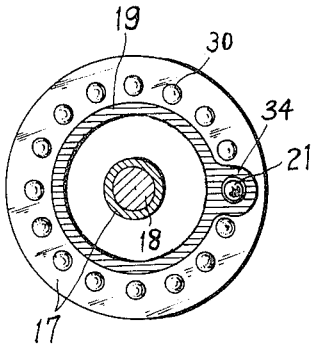
FIG. 3 is the a cross sectional view taken on line III—III of FIG. 2.

The mark "X" in FIG. 2 shows in phantom the position of the stand 10 adjusted 90° from the orginal position shown. It is suitable for being used as a suspension fan. Within the curved-adjusting frame 7 any angle can be adjusted within 0°–90° angle of elevation and a small angle of depression.

Figure 5:
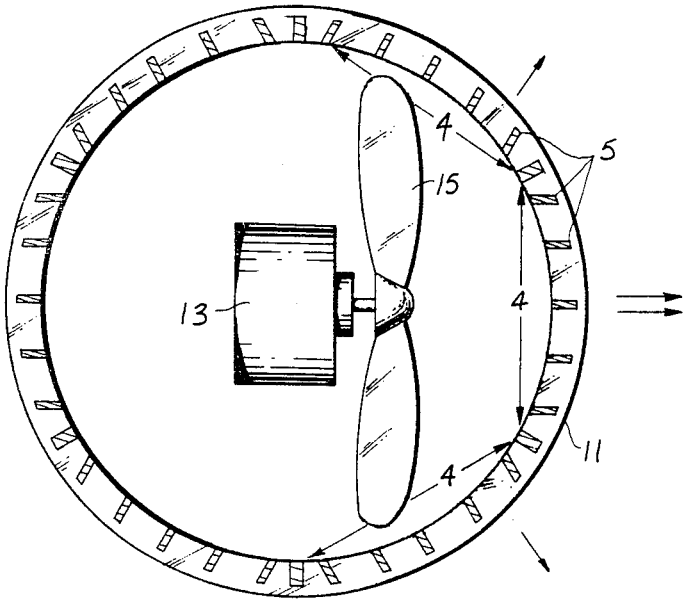
FIGS. 5, 6, 7 and 8 are the cross sectional views taken on line V—V of FIG. 2, but FIG. 8 showing an embodiment with four faces.
Figure 6:
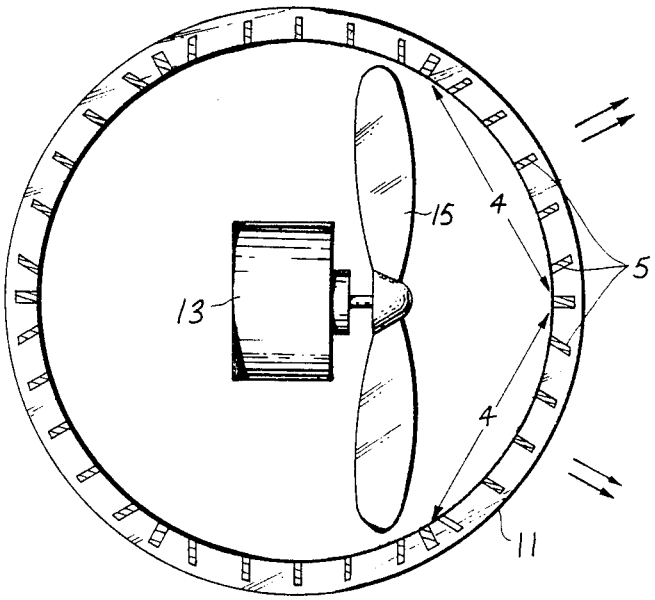
Figure 7:
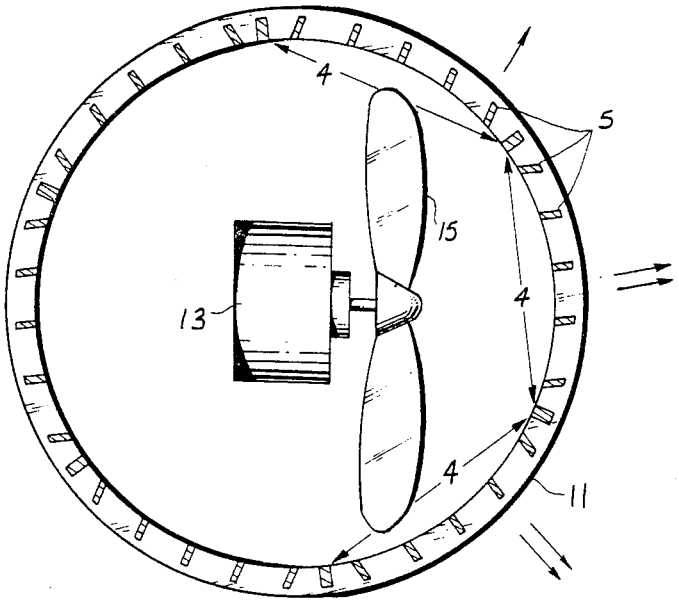

FIGS. 5, 6 and 7 are the cross sectional views of FIG. 2 showing the sphere-like shell 3 turned to different positions with respect to the motor and blade. The "arrows" in FIGS. 5, 6, 7 and 8 show the direction of the wind. A double arrow means stronger wind. In FIG. 5 the wind blows out through three wind guiding vane sets (or three different faces) 4, but the stronger wind blows out from the middle set 4 because all of the area of only middle set 4 is in front of the fan blades 15. In FIG. 6, only two wind guiding vane sets 4 are in front of the fan blades 15, so that the wind blows out through the two sets 4 evenly. In FIG. 7, the wind blows out through the two lower sets 4 stronger than through the upper set 4. Therefore the wind field is varied by turning the wind guiding vane sets. FIG. 8 shows the embodiment having four vane sets positioned for splitting the air flow equally between two vane sets 4.

FIG. 9 shows a further embodiment of the invention wherein shell 3 comprises five wind guiding vane sets 4 of different sizes having the faces shown by the chords in dash lines. If all the wind guiding vanes 5 of each set 4 are perpendicular to the chord face of their own set, the wind-guiding vanes 5 are almost parallel to the face of the fan blades when they are positioned adjacent the tip of the front of the fan blades 15. In this position they will obstruct or over divert the wind from the fan blades 15 which results in reducing the wind force. The larger the size of the wind guiding vane set 4, the greater the wind force is reduced. Therefore the direction of the wind guiding vanes 5 at both ends of the larger wind guiding vane set 4 are changed according to the invention as shown in FIG. 9, areas A and B, so that they are not parallel to the central vane. The direction of more wind guiding vanes 5 of the larger wind guiding vane set 4 should be changed (A). The wind guiding vanes 5 in the areas A and B are outwardly inclined with respect to the central vane of each set. The nearer either end of the set 4, the larger the angle of inclination required. Thus, as shown schematically $>1\propto>2\propto>3\propto>4\propto>5\propto>6$, as shown in FIG. 9.

I claim:

1. An electric fan apparatus comprising:

a stand, a fan motor and blade, support means for mounting said fan motor adjustably on said stand, a substantially spherically shaped air directing shell, means for rotatably mounting said shell on said fan motor support means with said fan motor and blade within said shell, and a plurality of air guiding faces circumferentially spaced in the surface of said shell, each face comprising an opening through said shell and a plurality of air directing vanes in said opening, at least one of said vanes most centrally located in said opening extending substantially radially with respect to said shell.

2. An electric fan apparatus as claimed in claim 1 wherein said air guiding faces are spaced with respect to each other so that chords joining the circumferential ends of said sets from a polyhedron.

3. An electric fan apparatus as claimed in claim 2 wherein said chords form a regular polyhedron having six faces, and said vanes of each set are parallel.

4. An electric fan apparatus as claimed in claim 4 wherein said support means comprises:

a fan motor mounting portion, and end portions extending therefrom, an adjusting frame member attached to the outer end of one end portion comprising a curved member extending substantially concentrically and in spaced relationship with respect to said shell, and clamping means for releasably clamping said stand at various positions along said curved member to vary the position of said fan and shell with respect to said stand.

5. An electric fan apparatus as claimed in claim 4 wherein said means for rotatably mounting said shell on said support means comprises a bore through said shell, a first bearing means in said bore, said one end portion extending through said bore in engagement with said bearing means, a second bearing means mounted at the outer end of the other end portion of said support means, and a mounting ring on said shell diametrically oppositely to said bore and engaging said second bearing means.

6. An electric fan apparatus as claimed in claim 5 and further comprising a synchronous motor mounted at the outer end of said other end portion of said support means and having a drive shaft extending therefrom, said second bearing means being mounted on said drive shaft, and releasable engaging means interengaging said drive shaft with said mounting ring so that synchronous motor rotates said sphere when said engaging means is in the engaged position.

* * * * *